United States Patent [19]

Kerekes

[11] 4,160,186

[45] Jul. 3, 1979

[54] CLOSURE STRUCTURE OF ELECTRIC DISCHARGE TUBES

[75] Inventor: Béla Kerekes, Budapest, Hungary

[73] Assignee: Egysült Izzólámpa és Villamossági Reszvenytarsasag, Budapest, Hungary

[21] Appl. No.: 851,596

[22] Filed: Nov. 14, 1977

[30] Foreign Application Priority Data

Jan. 6, 1977 [HU] Hungary ..... EE 2471

[51] Int. Cl.[2] ..... H01J 61/36

[52] U.S. Cl. ..... 313/220; 313/331

[58] Field of Search ..... 313/220, 331, 317, 318

[56] References Cited

U.S. PATENT DOCUMENTS

| | | | |
|---|---|---|---|
| 3,609,437 | 9/1971 | Tol et al. | 313/220 |
| 3,886,392 | 5/1975 | Barakitis et al. | 313/220 |
| 4,052,635 | 10/1977 | Jacobs | 313/331 X |

*Primary Examiner*—Eugene R. LaRoche

[57] ABSTRACT

Electric discharge tube having a hollow cylindrical bulb formed either of a ceramic material or from sapphire having first and second open ends. First and second end caps or closure members are fitted over the ends to form capillary action passages between the first and second closure members and the end portion of the bulb member such that solder will flow when heated to join the members together on cooling of the solder. One or more of the end closure members may have a metallized surface formed thereon. The end closure members may extend along either the inside or the outside surface of the cylindrical bulb member or both the inside and the outside surfaces of the bulb member. A hollow cylindrical ceramic member may be fitted to the end portion of the bulb member and itself be fitted with a plurality of closure members at one of its ends and a third hollow ceramic member at its other end to form an air-tight sealed tube.

9 Claims, 6 Drawing Figures

CLOSURE STRUCTURE OF ELECTRIC DISCHARGE TUBES

BACKGROUND OF THE INVENTION

The present invention relates to a closure or termination structure for electric gas discharge tubes or lamps. Such tubes are formed with bulbs made of ceramic and sapphire materials. The present invention also relates to the lead construction i.e. to the method and structure by which the current is brought into the tube which causes it to glow.

It is well known in the art that gas discharge tubes or lamps may be made of ceramic or sapphire and that such lamps may have alkali metals disposed inside the tube. Such alkali metal vapor lamps have several operational problems because they operate at high temperatures and because it is desirable and common to use the closure member to serve as the current lead-in structure. As a result only metals can be used for closure which are chemically resistant to alkali metal vapors and which have a coefficient of thermal expansion which is similar to that of the ceramic or sapphire materials used in the tube.

If the ceramic tube or lamp is made of a poly-crystalline alumina, niobium can be used for the closure member. Although niobium's coefficient of thermal expansion is slightly less than that of the ceramic the difference in thermal coefficients may be compensated for if the closure member is made of a thin plate the surface of which is roughened by sintering a foreign material thereto. This sintered structure of niobium and foreign material has a greater elasticity and better adhesive strength in conjunction with the solder than the niobium alone. Such a structure is taught in U.S. Pat. No. 3,243,635.

It is also known in the art that a better bond can be formed using a ceramic tube if the ceramic tube is closed by a ceramic plug having a metallized surface. The reason for this is that the plug or end cap can be made of the same material as the ceramic tube therefore the coefficient of thermal expansion and the alkali resistant properties are obviously well matched. This structure is taught in U.S. Pat. No. 3,693,007.

Even where end caps and bulbs having identical coefficients of thermal expansion are soldered together, stresses may occur if the masses of the components are different and the heating and cooling does not take place simultaneously. Naturally these effects are common ones since the masses of the end caps and the tubes are not the same nor is their proximity to the heating elements identical, nor is the heat flow away from the tubes and caps identical since that would depend on the physical disposition or placement of the members. Therefore when lamps are switched on or off or even in some steady-state conditions it is common that different thermally generated mechanical stresses will exist.

The end closure is particularly less certain when sapphire tubes are used instead of poly-crystalline alumina ceramic tubes. The coefficient of thermal expansion of the sapphire not only is larger than that of the poly-crystalline alumina but it is also larger than that of niobium and the ceramic plugs respectively.

It is an object of the present invention to teach an end cap or closure construction for ceramic or sapphire tubes which is more resistant to thermally caused stresses and which does not require an increase in the number of soldering and other closing or sealing operations.

SUMMARY OF THE INVENTION

To achieve the objects of the present invention the end closure is formed from two cylindrical closing members fitted with respect to each other and with respect to the tubular bulb or lamp member such that the spaces between the respective end closure members and the tubular bulb member have a clearance such that capillary action for a melting (liquid) solder will occur therebetween.

The present invention teaches that each of the closing members and the end surface of the tube which appears as a circular cross section will have a capillary action therebetween such that at least three capillary tubes communicating together are formed.

When during the course of the soldering operation the liquid solder is placed in the vicinity of the capillary tubes it will flow because of the capillary action in each of the tubes and when the heat is removed leaving a solid closed end formed on the tube.

DESCRIPTION OF THE PREFERRED EMBODIMENTS

In the figures like parts have like numbers in the various embodiments differentiated by the a, b, c, or d designation for example part 1, 1*a*, 1*b*, 1*c*, 1*d* are all functionally and structurally similar parts.

Figure 1:
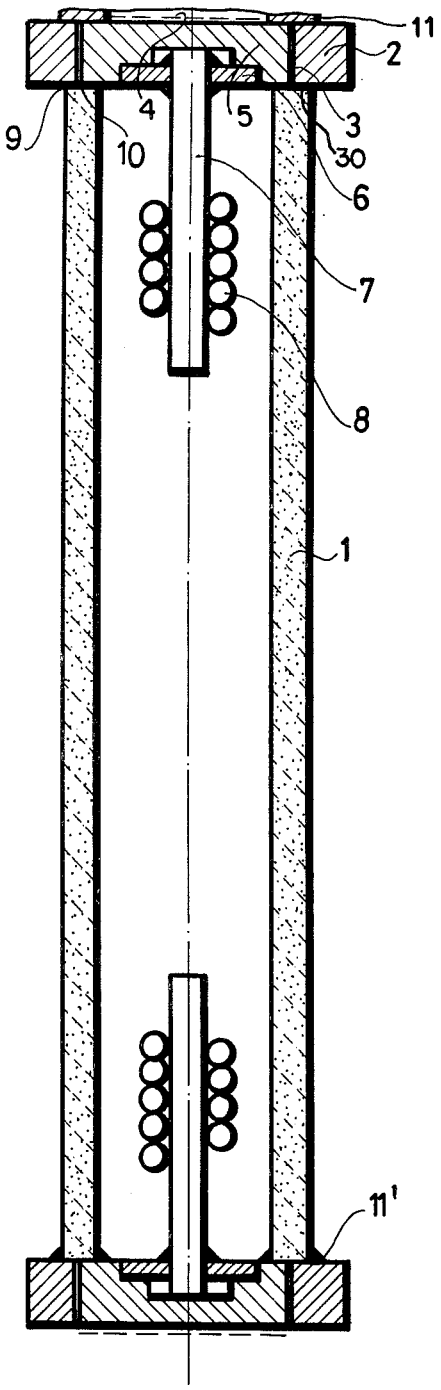
FIG. 1 shows in section a view of one embodiment of the present invention.

Turning now to FIG. 1 the discharge tube or bulb member is seen in its entirety consisting of a cylindrical ceramic or sapphire hollow cylinder 1. A ceramic ring or hollow member 2 is arranged on the frontal or end surface of the bulb 1. A second ceramic disc or hollow cylinder 5 provided with a metallized surface 4 (i.e. with a metal deposited on a surface as shown) is inserted into the ring or cylinder member 2 forming a clearance 3 and 9 between them. The spacing of the clearances 3 and 9 is such that a capillary action will occur with a liquid solder, that is, a solder heated to the proper temperature to be liquid. The rings 2 and 5 are supported on the end 30 of the tube 1. Naturally there are really two ends 30 to the tube.

A tungsten electrode 7 is inserted into the second ceramic disc 5 by interposing a metal plate 6 and a tungsten spiral 8 which is welded to the electrode. The ceramic ring 2 and the tube end 30 as well as the second ceramic ring 5 and the tube end 30 also form a capillary clearance 10 therebetween. This capillary clearance or spacing 10 results from the uneven surface of the ceramic or sapphire components.

A ring of solder 11 is placed above or on the capillary spacings 3 and 9 and then heated such that the solder will liquify and flow through the capillary tubes 3, 9 and 10 to form a solid mass sealing the end of the tube, as shown in the lower end of FIG. 1 by the solder fillets 11'.

Construction of the tubes illustrated in FIGS. 1 to 6 are symmetrical with respect to the ends of the tubes. That is the lower end of the tube is similar to the upper end and therefore in the further embodiments shown in FIGS. 2 to 6 only one end of the tube is shown. In FIG. 1 the flowed solder 11' is shown as having flowed through the capillary clearances 3, 9 and 10 to form the finished article as shown in the lower portion of FIG. 1.

In forming the discharge tubes according to the present invention one end of the tube will be sealed and have its end turned down. The discharging or ionizing material such as metallic sodium is placed into the tube member 1 and the previously described components of the ceramic rings placed onto the end 30 of the tube under an outer bulb preferably made of glass. The air is pumped out from the tube through the capillary clearances 3, 9 and 10. The annular solder ring 11 has been melted in a rare gas atmosphere of 30 to 40 mm. mercury pressure. The rare gas trapped in the tube member 1 facilitates the ignition within the discharge tube. When the lamp is switched on the heat of the discharge of the rare gas evaporates the solid material which may be a sodium and thus vapor deposits it in the tube. This general structure for forming the tube in the low pressure chamber is shown in U.S. Pat. No. 3,967,871 invented by Bela Kerekes and described in that specification.

Figure 2:
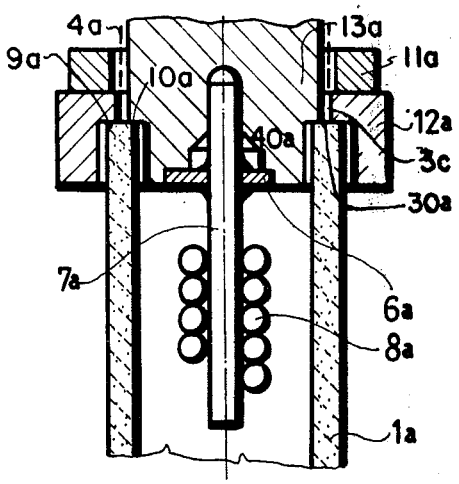
FIG. 2 shows a sectional view of a portion of a second embodiment of the present invention prior to the flowing of solder.
Figure 3:
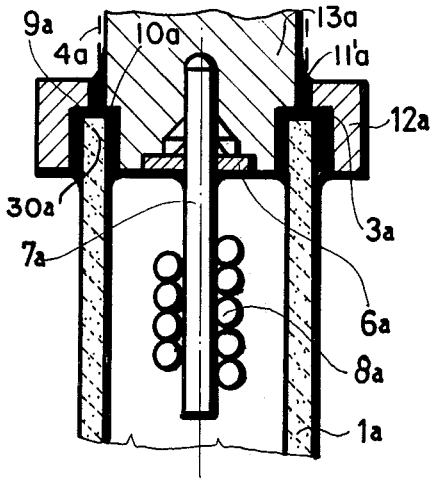
FIG. 3 shows a view of the embodiment shown in FIG. 2 after the solder has flowed in the capillary tubes.

Turning now to FIGS. 2 and 3 wherein is shown a second embodiment of the present invention. An outer ceramic ring **12*a* having a generally L-shaped cross section as shown in FIG. 2 is fitted over the end 30*a* of the tube 1*a*. A larger ceramic member also having a generally circular shape on the common axis formed by the tube and the outer ceramic member 12*a* is formed which has an axially extending portion 40*a* and extends into the tube 1*a* and has a portion resting on the end 30*a* of the tube 1*a*. Capillary gaps 3*a*, 9*a* and 10*a* are formed as shown in FIG. 2. A solder ring 11*a* is fitted on the outer surface of the first ceramic collar 12*a* and placed in the rare gas atmosphere. The chamber is then evacuated and heated and the solder flows through the capillaries 3*a*, 9*a* and 10*a* to form the finished product shown in FIG. 3. The flowed solder is indicated by the numeral 11'*a***.

The outer and inner or first and second ceramic rings **12*a* and 13*a* have the capillary separations 3*a* and 9*a* as shown and they in turn because of their own rough surfaces and that of the tube end 30*a* form another capillary separation 10*a* as shown in FIG. 2. It is noteworthy that the capillary surfaces 3*a* and 9*a* extend along the inner and outer surfaces of the tube 1*a* to form an annular ring of solder both inside and outside of the tube 1*a***.

The second ceramic member **13*a* is formed from a production viewpoint in a favorable manner since the solder ring 11*a* is maintained in its position by the outward projection of the second ceramic ring 13*a*. Further the staggered formation of the ceramic ring 12*a* with respect to ring 13*a* also facilitates the maintenance of the collar of solder 11*a* in the appropriate position. The staggered formation of the ceramic ring 12*a*** also increases the resistance to thermal shock.

Figure 4:
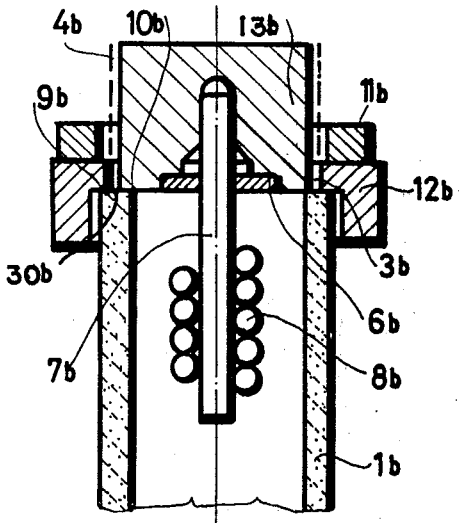
FIG. 4 shows a partial view in section of a third embodiment of the present invention.

The embodiment illustrated in FIG. 4 is substantially identical to that shown in FIGS. 2 and 3 except that the second ceramic ring or closure member **13*b* is without the extension 40*a* shown in FIG. 2. That is, member 13*b* does not extend into the chamber inside of the tube 1*b*. This embodiment has the advantage that only one dimension of the component 13*b* needs to be formed with as great precision as is normally required in ceramics. Therefore this gives an additional degree of freedom that the FIGS. 2 and 3** embodiment lacks.

Figure 5:
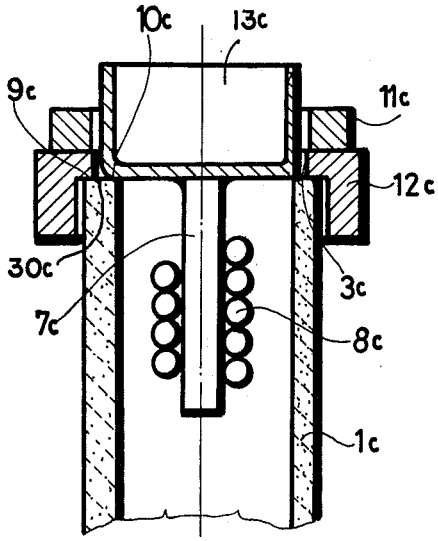
FIG. 5 shows a partial view in section of a fourth embodiment of the present invention.

In the embodiment shown in FIG. 5 the second ceramic element **13*c* is shown as a disc having a hollow interior which is cup-shaped. The second ring member 13*c* as shown in FIG. 5** is conveniently made of a metal such as niobium or tantalum. However it could be formed of ceramic also.

In fact both of the disc members 12 and 13 in their various embodiments may be made of metal or one may be made of metal and the other be made of ceramic.

Figure 6:
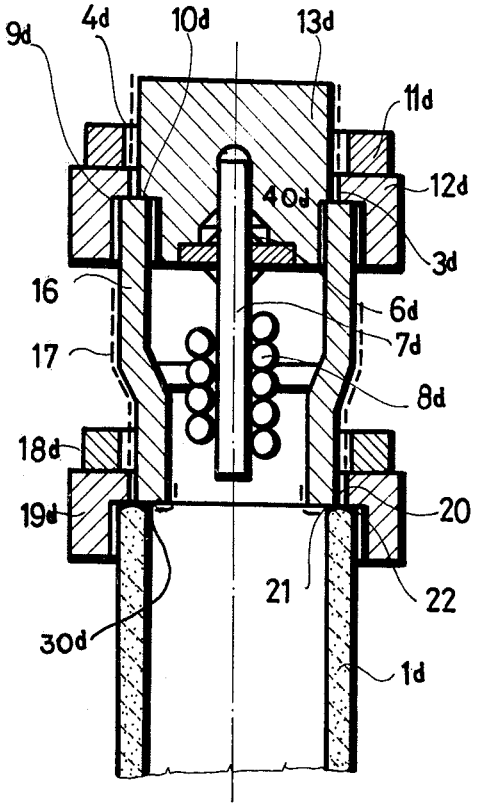
FIG. 6 shows a partial view in section of a fifth embodiment of the present invention.

Turning now to the embodiment shown in FIG. 6 we see that a third ceramic member 16 has a stepped exterior and interior surface in which the exterior may have a metal deposit 17 formed thereon. The third member 16 is of a generally cylindrical cross section and has a common center with the tube **1*d* and the first and second ceramic members 12*d* and 13*d* respectively. The tubular member 16 has an outer diameter less than the outer diameter of the tube 1*d* on its smaller segment and its larger segment has an outer diameter approximately equal to the outer diameter of the tube 1*d*. This construction enables members 19 and 12*d* to be interchangeable. It also enables the annular solder rings 18 and 11*d*** to be interchangeable.

Ceramic ring 19 forms capillary clearnaces 20, 21 and 22 with the ceramic core 16 and the tube **1*d*. The upper part of the closure of the tube 16 is substantially identical with the structure used and described in the FIGS. 2 and 3 embodiments. The entire structure will be evacuated and then heated in the manner described in connection with the FIG. 2 embodiment and the solder rings 11*d* and 18 will become liquid and the capillary action will cause the solder to form the well known solder fillets as shown in FIGS. 1 and 3**.

The structure shown in FIG. 6 illustrates a double current feed or lead in the system at the end of the tube. The metal layer **4*d* leads current to the main electrode 7 while the metal layer 17 formed on the intermediate ceramic ring 16** extending through the soldered zone along the inside of the tube functions as the ignition electrode.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. An electric discharge tube comprising a tubular bulb means formed from ceramic material having first and second open end portions;

a first closing member fitted substantially over at least one of said open end portions of said bulb means;

a second closing member fitted over a portion of said one of said open end portions and spaced from said first closing member by a distance such that capillary action will occur therebetween; and, said first and second closing members being so spaced from said one end portion of said bulb means that capillary action between said closure members and said end portion will occur.

2. The device claimed in claim 1 wherein said tubular bulb means has a circular symmetry having a center line;

said tubular bulb means and first and second closing members are disposed on said center line.

3. The device claimed in claim 1, wherein at least one of said closing members extends along a portion of said tubular bulb means and is distanced therefrom a separation such that capillary action there between can occur.

4. The device claimed in claim 1 wherein at least one of said closing members is formed of a ceramic material having surfaces at least one of which has a portion thereof covered by a metallic deposition.

5. The device claimed in claim 1 wherein at least one of said closing members is formed from a metal.

6. The device claimed in claim 5 wherein said metal is niobium or tantalum.

7. The device claimed in claim 1 wherein a hollow ceramic body having surfaces at least one of which has a metal deposit thereon is connected to said end portion of said tubular bulb means.

8. The device as claimed in claim 7 wherein said hollow ceramic body member has a stepped surface so that it has a portion with an inner diameter less than that of said tubular bulb member and a portion with an inner diameter substantially equal to said bulb tubular member inner diameter.

9. The device claimed in claim 1, wherein said tubular bulb means comprises a first hollow cylindrical member and a second hollow ceramic body member coaxial therewith and having a stepped surface, said second hollow ceramic body member having a surface which has a metal deposit thereon, and comprising a third hollow ceramic cylindrical member coaxial of said first hollow cylindrical member and said second hollow ceramic body member, the third hollow ceramic cylindrical member forming capillary passages between it and said first hollow cylindrical member and said second hollow ceramic body member.

* * * * *